US006911964B2

(12) United States Patent
Lee et al.

(10) Patent No.: US 6,911,964 B2
(45) Date of Patent: Jun. 28, 2005

(54) FRAME BUFFER PIXEL CIRCUIT FOR LIQUID CRYSTAL DISPLAY

(75) Inventors: Sangrok Lee, Durham, NC (US); James C. Morizio, Durham, NC (US); Kristina M. Johnson, Durham, NC (US)

(73) Assignee: Duke University, Durham, NC (US)

( * ) Notice: Subject to any disclaimer, the term of this patent is extended or adjusted under 35 U.S.C. 154(b) by 0 days.

(21) Appl. No.: 10/289,459

(22) Filed: Nov. 7, 2002

(65) Prior Publication Data

US 2004/0090411 A1 May 13, 2004

(51) Int. Cl.[7] ..... G09G 3/36
(52) U.S. Cl. ..... 345/90; 345/92; 349/42
(58) Field of Search ..... 345/87–104, 204–214, 345/695–699; 349/41, 42, 49, 50, 51

(56) References Cited

U.S. PATENT DOCUMENTS 5,627,557 A * 5/1997 Yamaguchi et al. ..... 345/90
5,856,812 A * 1/1999 Hush et al. ..... 345/74.1
5,959,598 A * 9/1999 McKnight ..... 345/90
5,977,940 A * 11/1999 Akiyama et al. ..... 345/94
6,046,716 A * 4/2000 McKnight ..... 345/95
6,064,362 A * 5/2000 Brownlow et al. ..... 345/98
6,329,974 B1 * 12/2001 Walker et al. ..... 345/98
6,421,037 B1 * 7/2002 Chen ..... 345/92
6,440,811 B1 * 8/2002 Coolbaugh et al. ..... 438/324
6,476,786 B1 * 11/2002 Miyachi ..... 345/90
6,525,709 B1 * 2/2003 O'Callaghan ..... 345/98
6,542,142 B2 * 4/2003 Yumoto et al. ..... 345/90
2001/0024186 A1 * 9/2001 Kane et al. ..... 345/98
2003/0085862 A1 * 5/2003 Tsutsui ..... 345/90

* cited by examiner

*Primary Examiner*—Dennis-Doon Chow
(74) *Attorney, Agent, or Firm*—Fleshner & Kim, LLP

(57) ABSTRACT

An enhanced frame buffer pixel circuit with two control transistors and a separate capacitor put in as a memory capacitor before the memory transistor yields a high contrast ratio by removing induced charge and solving a charge sharing problem between the memory capacitor and the liquid crystal display (LCD) capacitor. The memory transistor may be made of either CMOS or PMOS. The frame buffer pixel can be used to drive binary displays which expresses ON and OFF only if a comparator is put in after the pixel electrode circuit to represent gray levels with reduced sub-frame frequency.

22 Claims, 18 Drawing Sheets

A REFINED FRAME BUFFER PIXEL CIRCUIT

Fig. 1. DISPLAY DEVICE

Background Art

FIG. 2 FRAME BUFFER PIXEL

BACKGROUND ART

Figure 3. Hspice simulation results for the conventional frame buffer pixel display voltage levels at nodes with respect to time.

FIG. 4 BUFFER PIXEL FRAME

BACKGROUND ART

FIG. 5 HSPICE SIMULATION RESULT FOR A CONVENTIONAL FRAME BUFFER CIRCUIT

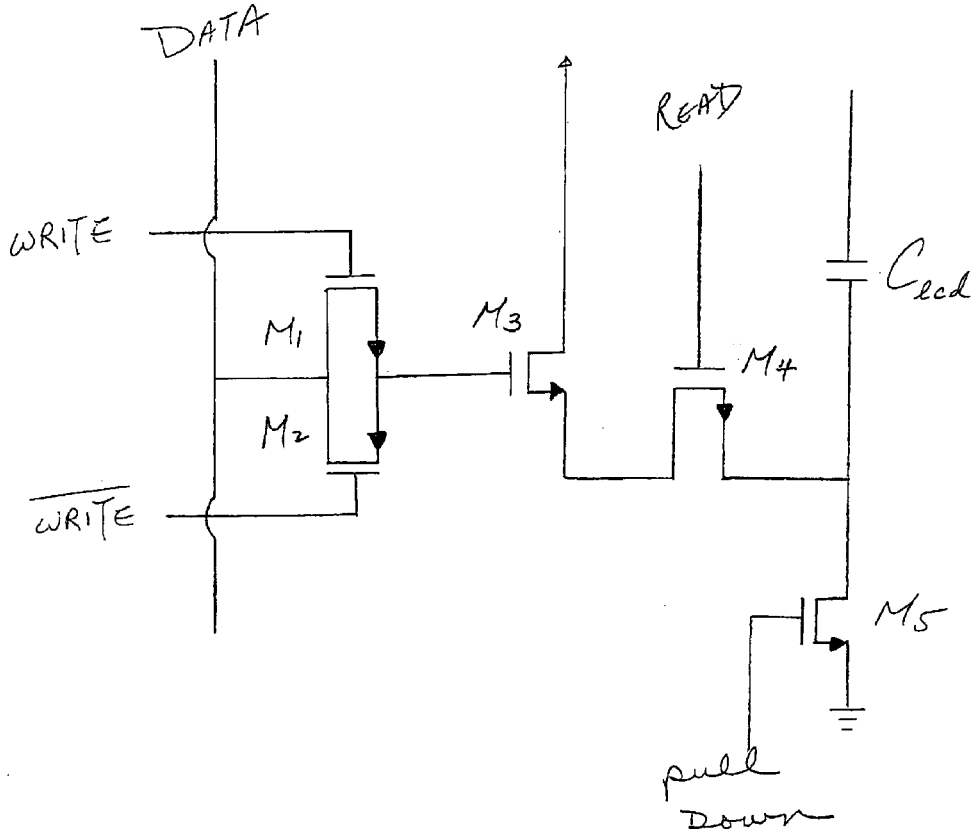
Fig. 7 A REFINED FRAME BUFFER PIXEL CIRCUIT

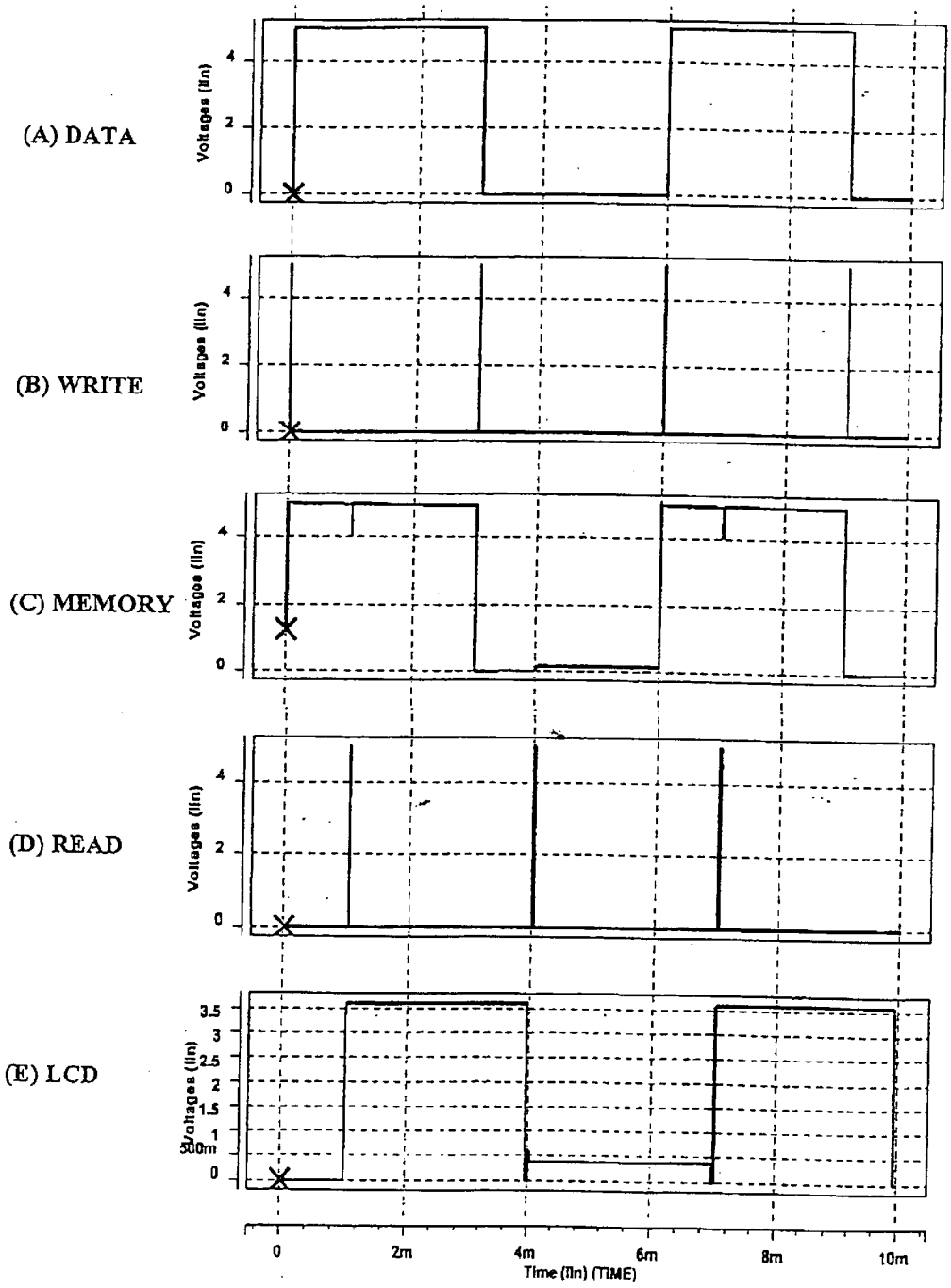
Figure 8. Hspice simulation results performed for FIG. 7 frame buffer pixel showing voltage levels at nodes with respect to time.

FIGURE 9. Gate capacitance depending on the voltage applied to the gate ( capacitance : ff)

| Voltage | 0 V | 0.8 V | 2 V | 3 V | 4 V | 5 V |
|---|---|---|---|---|---|---|
| PMOS | 165.9 | 165.9 | 165.9 | 166 | 150.6 | 75.7 |
| NMOS | 76 | 137.3 | 167.6 | 167.5 | 167.4 | 167.4 |

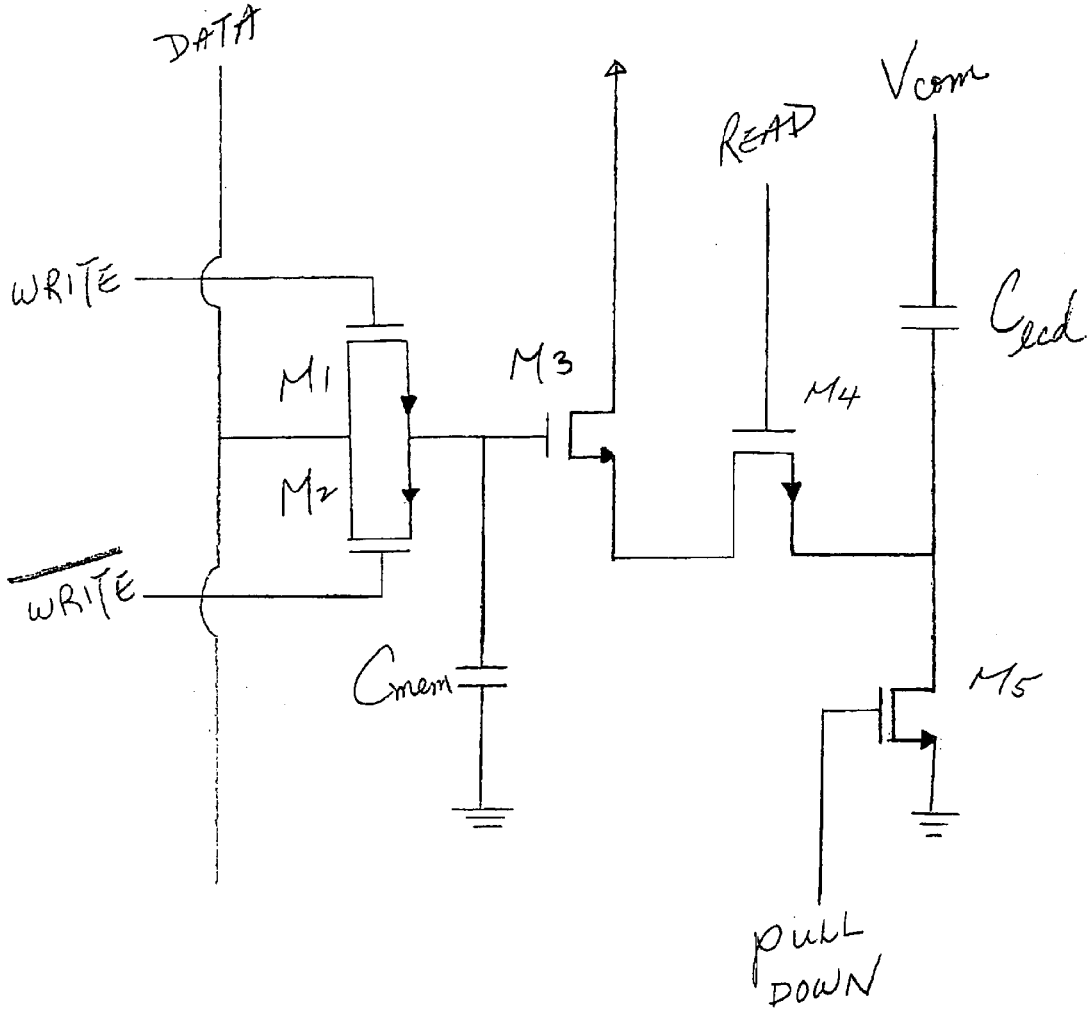
FIG. 10. FRAME BUFFER PIXEL CIRCUIT in CMOS

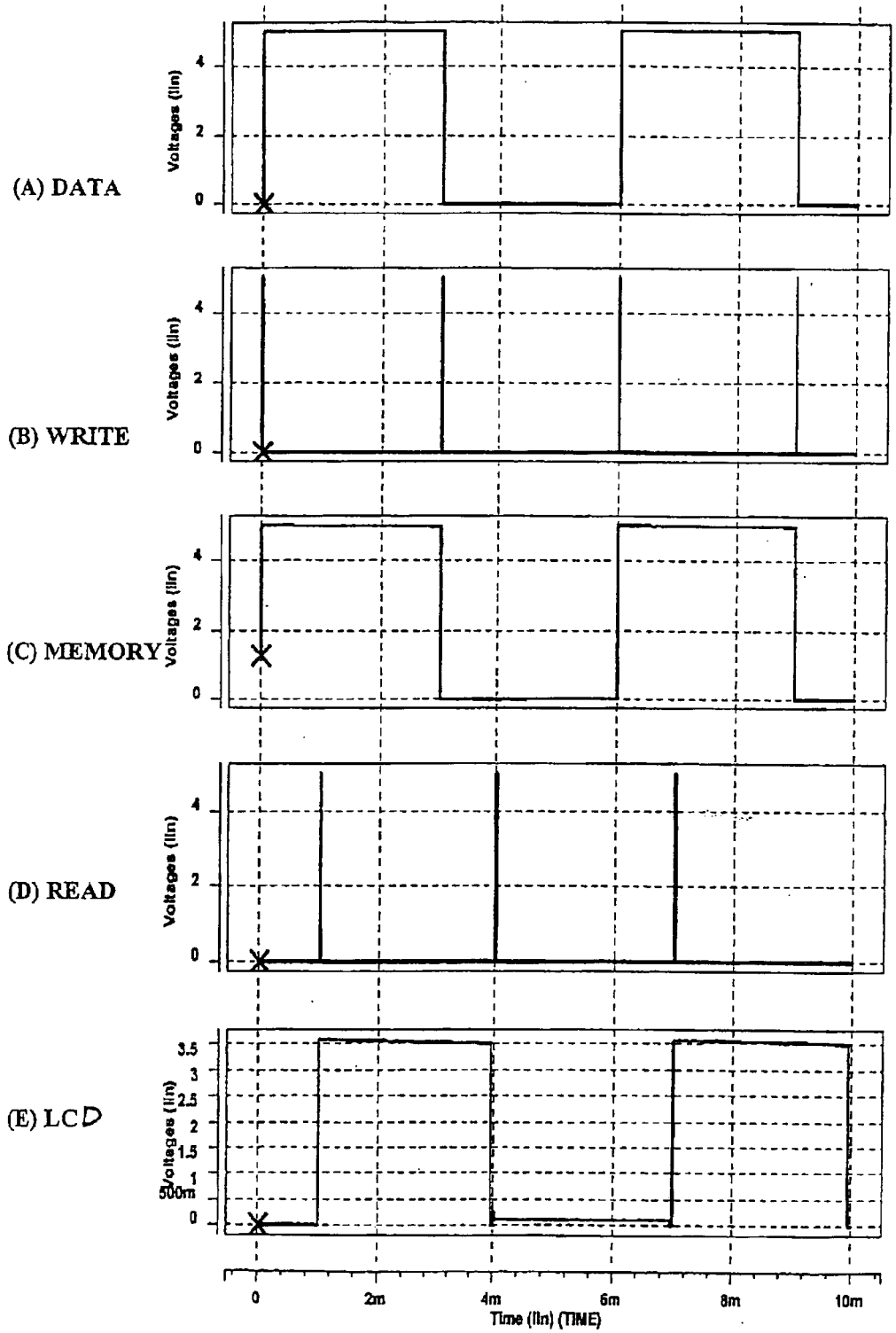
Figure 11 Hspice simulation results performed for the FIG. 10 frame buffer pixel ILLUSTRATING voltage levels at nodes with respect to time.

FIG. 13 FRAME BUFFER PIXEL CIRCUIT

IN : PMOS

Figure 14 Frame buffer pixel with a comparator.

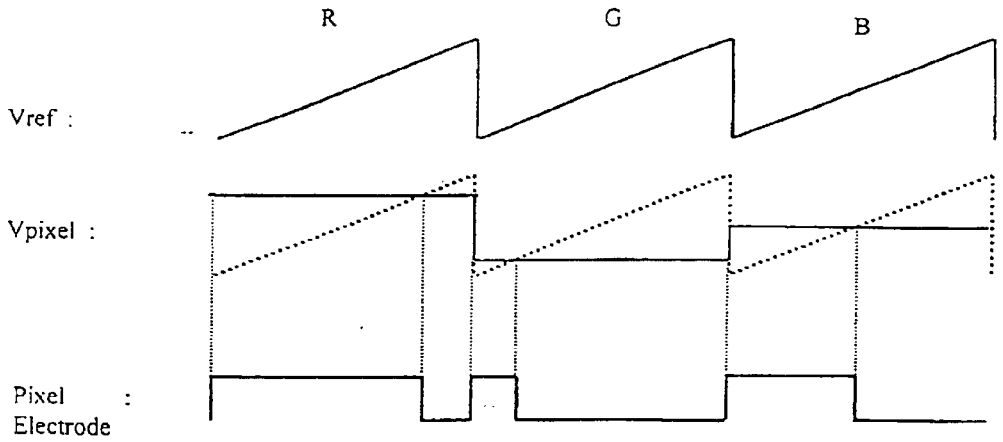
Figure 16 PWM waveform generated from the pixel voltage and reference voltage.

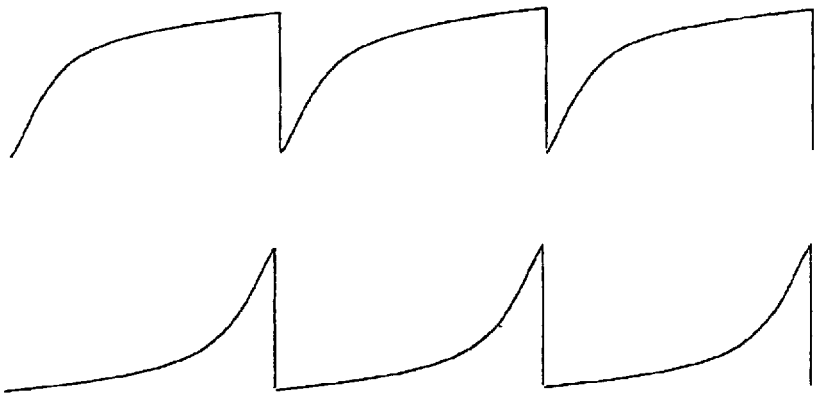
Figure 17 WAVEFORM OF THE REFERENCE VOLTAGE VARIED TO APPLY GAMMA CORRECTIONS.

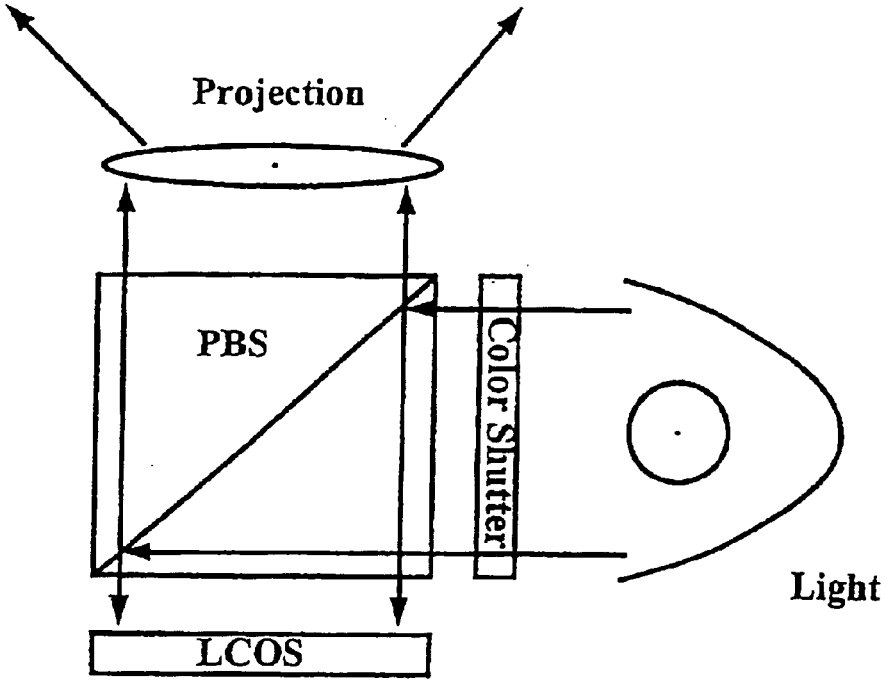
Figure 18 1-panel projection display with field sequential color.
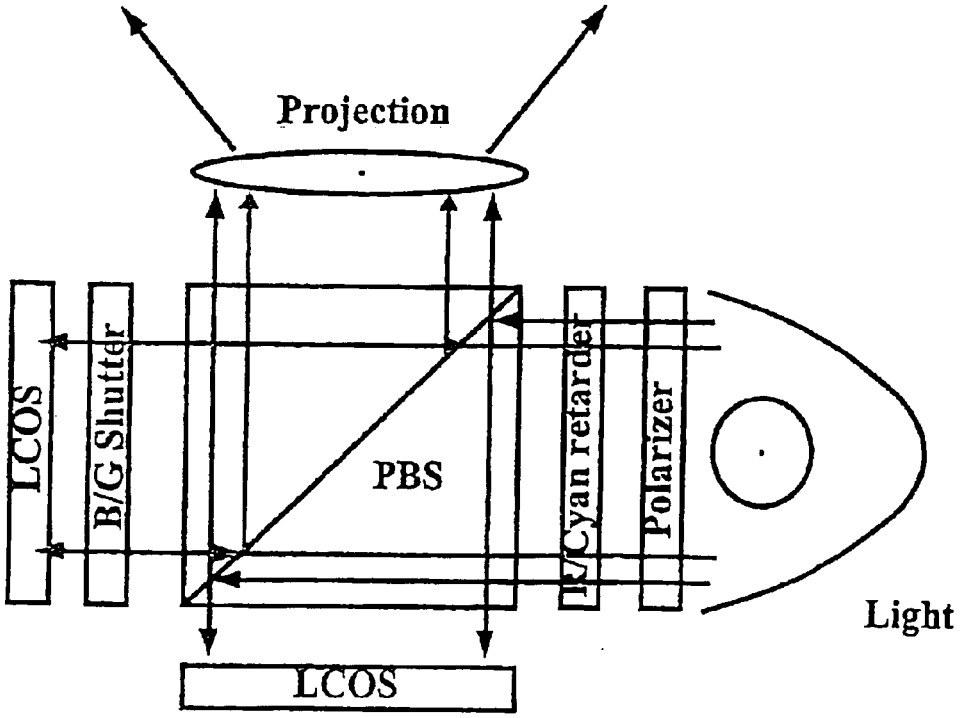
Figure 19 2-panel projection display with partial field sequential color.

FRAME BUFFER PIXEL CIRCUIT FOR LIQUID CRYSTAL DISPLAY

BACKGROUND OF THE INVENTION

1. Field of the Invention

This invention relates to pixel circuits for display systems, and more particularly relates to a frame buffer pixel circuit for a liquid crystal display.

2. Background of the Related Art

FIG. 1 shows a related art display device 10. It includes a pixel circuit display panel 20 controlled by a display control circuit 30 having a frame memory 40. The related art pixel circuit display requires a grayscale representation of more than 8 bits per color, and an operating voltage low enough to enable a battery powered display device, such as a laptop computer or a personal digital assistant (PDA). The related art pixel circuit utilizes an address driver for address selection and a scan driver for image switching and reading cycles during displaying.

FIG. 2 illustrates a related art early stage frame buffer pixel system for a liquid crystal display. Initially, a voltage proportional to the Data level is stored at the $C_{mem}$ memory capacitor during data write time when the Write signal is ON. Then, the stored voltage is transferred to the $C_{cd}$ capacitor when the Read signal is applied after data writing is finished. The frame buffer pixels enable a previously stored image to be displayed while new data for a new image is loading into $C_{mem}$.

The related art frame buffer pixel circuit has various disadvantages. For example, there is a charge sharing between the $C_{mem}$ memory capacitor and the $C_{lcd}$ capacitor, the two capacitors are shorted when the Read signal turned ON, as shown in FIG. 3(C)–(E). The voltage levels of the $C_{mem}$ memory capacitor, shown in FIG. 3(C), and the $C_{lcd}$ capacitor, shown in FIG. 3(E), become equal after the Read signal is applied, shown in FIG. 3(D). Hence, the capacitance of the $C_{mem}$ memory capacitor has to be much larger than the capacitance of $C_{lcd}$ capacitor in order to minimize the charge sharing problem. However, even with a much larger $C_{mem}$ memory capacitor, there is always some voltage drop due to the charge sharing effect.

Additionally, there is no charge drain at the $C_{lcd}$ capacitor. That is, the remaining charge at the $C_{lcd}$ node from the previous image interferes with the new voltage that is written for a new image. Specifically, the actual voltage level of the $C_{lcd}$ capacitor varies depending on the previous image voltage, as shown in FIG. 3(E).

Moreover, the $C_{lcd}$ capacitor is driven not by power, but is driven by the charge from the $C_{mem}$ memory capacitor. Thus, the $C_{lcd}$ capacitor needs to be optimized first in terms of its holding time and the capacitance of the $C_{mem}$ memory capacitor. Due to these disadvantages, the related art frame buffer pixel provides poor brightness and contrast ratio.

FIG. 4 illustrates a second related art frame buffer pixel circuit. The frame buffer pixel utilizes gate oxide of NMOS transistor M3 as a memory capacitor. The voltage according to Data level is stored at the gate capacitor of M3 during data writing time when Write signal is ON. When the data writing is finished, the Pullup signal corresponding to Read signal is turned ON and charging the pixel electrode (e.g., $C_{lcd}$ capacitor). Before Pullup signal is applied, the Pulldown signal drains all charge previously stored in the pixel electrode. The charge drain of the $C_{lcd}$ capacitor ensures the right voltage gets displayed, especially when the data level for the new image is lower than the previous image data level.

The simulation results of the frame buffer pixel of FIG. 4 are shown in FIG. 5. As shown in FIG. 5(E), undesired charge is induced at the pixel electrode due to the intrinsic gate capacitor of M3 which makes another path to the ground with the $C_{lcd}$ capacitor. These two capacitors working as a voltage divider determines the induced voltage at the $C_{lcd}$ capacitor during data writing time. Referring to FIG. 5, with the parameters used in the simulation, about one third of the voltage at the memory capacitor is induced during data writing time, as shown in FIGS. 5(C) and 5(E). The induced charge affects the image quality, especially the contrast ratio. To reduce the charge induction problem, the ratio of the gate capacitance $C_{gs}$ to the $C_{lcd}$ capacitance should be increased, and the stored charge should be kept for at least one frame time. Therefore, in order to achieve a high contrast ratio, the pixel circuit requires considerable space for the gate capacitance value which is much higher than the liquid crystal display (LCD) capacitor to hold the stored voltage in most mili-second frame time applications.

The above references are incorporated by reference herein where appropriate for appropriate teachings of additional or alternative details, features and/or technical background.

SUMMARY OF THE INVENTION

An object of the invention is to solve at least the above problems and/or disadvantages and to provide at least the advantages described hereinafter.

It is another object of the claimed invention to provide an enhanced frame buffer pixel circuit that can achieve high contrast ratio and display high quality images with shorter writing time.

In the preferred embodiment of the frame buffer pixel circuit, two separate capacitors are utilized to yield higher contrast ratio by minimizing the induced charge during data writing or reading time, keeping the dark level at its lowest brightness and therefore saving data writing time. The capacitance of the separate capacitor does not depend on that of each other and, therefore, can be designed independently such that the time constant is long enough to hold the stored charge for one frame time. The capacitance of the separate capacitors is not voltage-dependent contrary to the gate capacitance. The lcd capacitor $C_{lcd}$ is directly driven by the power source, the current flowing into the lcd capacitor is controlled by the voltage level stored at the memory capacitor. Furthermore, there is no charge sharing between the memory capacitor $C_{mem}$ and the lcd capacitor $C_{lcd}$. There is charge induced only when data read signal is on, however the amount of charge induction is same for all data level. Thus the charge induction does not alter the gray level and the charge induced at the lcd capacitor can also be minimized by using minimum-sized transistor. In the preferred embodiment of the frame buffer pixel circuit, an analog to pulse width modulation (PWM converter can be put after the pixel electrode (i.e., lcd capacitor) $C_{lcd}$. Specifically, a pixel capacitor $C_{pixel}$ is preferably connected to a comparator with a reference voltage $V_{ref}$ to generate PWM pulses to drive binary displays such as ferroelectric liquid crystal displays and digital mirror displays (DMDs), reducing the sub-frame frequency significantly.

This pixel circuit with above described advantages can be applied in most displays which use active driving, such as TFT LCDs, liquid crystal on silicones (LCOSs), electro luminescence (EL) display, plasma display panels (PDPs) and field emission displays (FEDs), field sequential color display, projection display, and direct view display, such as a head mount display (HMD). This technique can also be used in LCOS beam deflector, phased-array beam deflector, and is especially effective in reflective display that adopt silicon substrate backplanes.

Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The invention will be described in detail with reference to the following drawings in which like reference numerals refer to like elements wherein:

FIG. 7 shows a frame buffer pixel circuit in accordance with another preferred embodiment of the present invention.

FIG. 8 shows simulation results for the frame buffer pixel circuit of FIG. 6.

FIG. 9 shows a table of the Gate capacitance depending on the voltage applied to the gate.

FIG. 10 shows a frame buffer pixel circuit with CMOS in accordance with a preferred embodiment of the present invention.

FIG. 11 shows simulation results for the preferred embodiment frame buffer pixel of FIG. 10, illustrating voltage levels at nodes with respect to time.

FIG. 16 shows a diagram illustrating PWM waveform generated from the pixel voltage and reference voltage of FIG. 13.

FIG. 17 shows a diagram illustrating the waveform of the reference voltage varied to apply gamma corrections.

FIG. 18 shows a 1-panel projection display with field sequential color according to a preferred embodiment of the present invention.

FIG. 19 shows a 2-panel projection display with partial field sequential color according to a preferred embodiment of the present invention.

DETAILED DESCRIPTION OF PREFERRED EMBODIMENTS

Preferred embodiments of the present invention will now be described with reference to the accompanying drawings.

Figure 1:
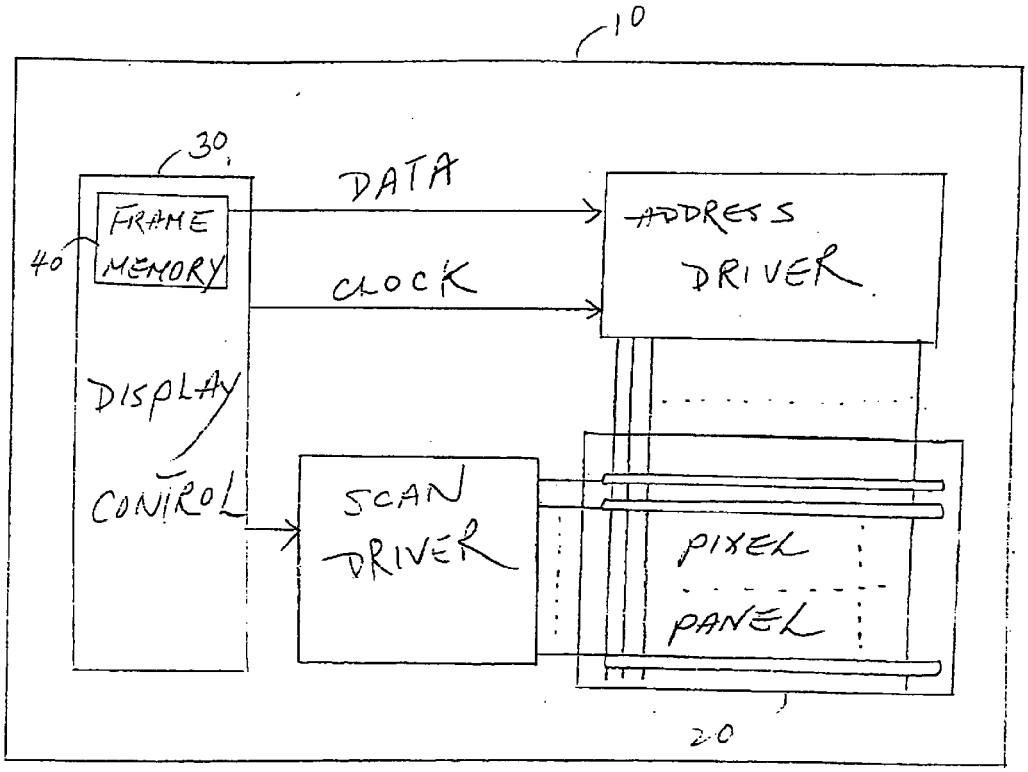
FIG. 1 is a diagram illustrating a general structure of a related art pixel panel display.
Figure 2:
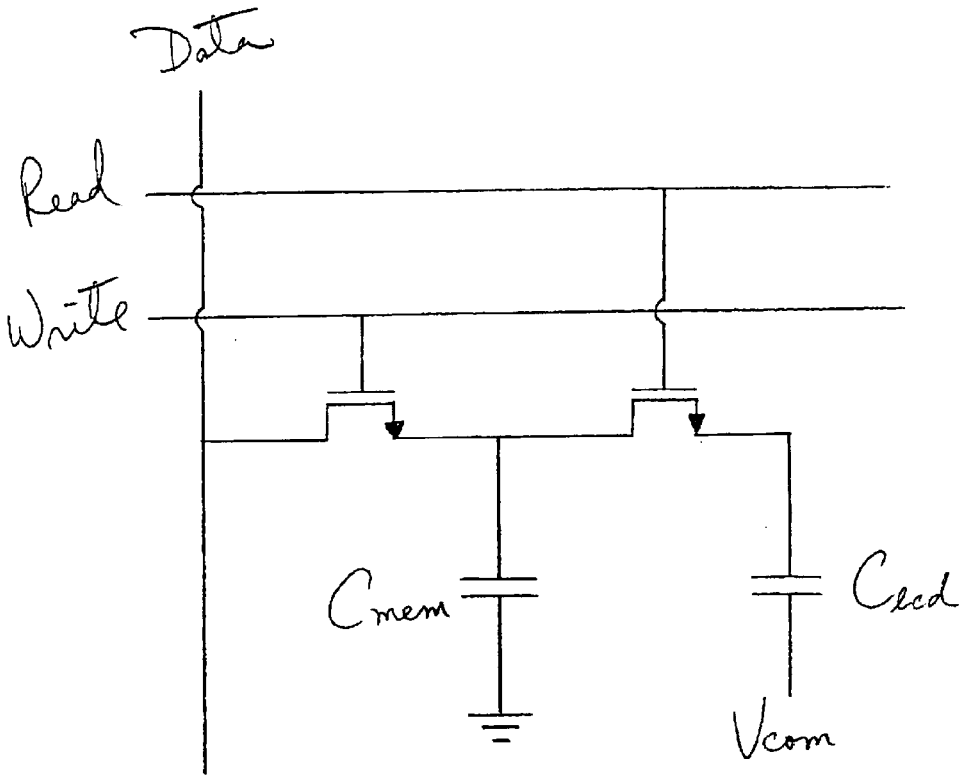
FIG. 2 is a diagram illustrating a first related art frame buffer pixel circuit.
Figure 3:
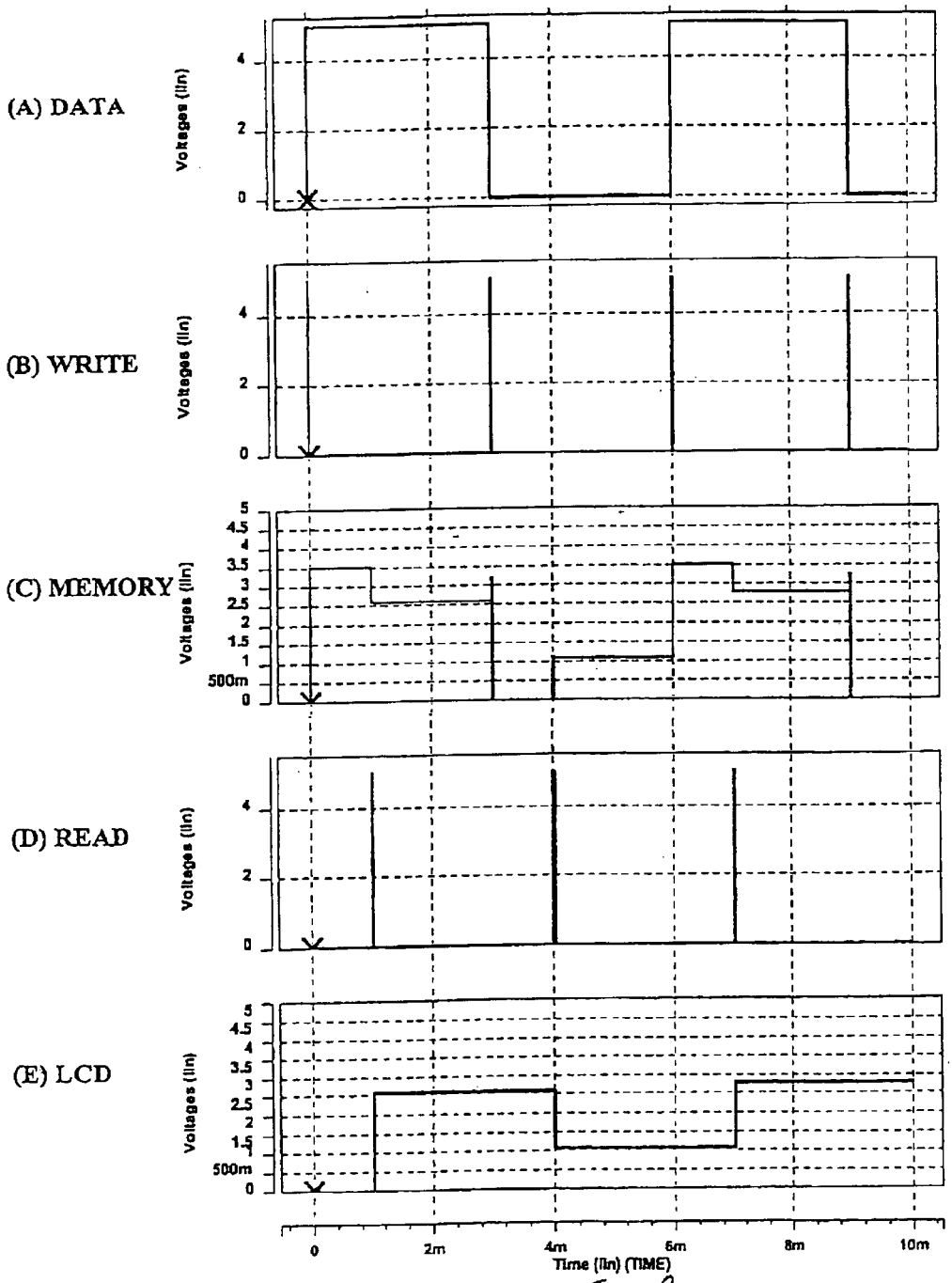
FIG. 3 shows simulation results for the frame buffer pixel circuit of FIG. 2.
Figure 4:
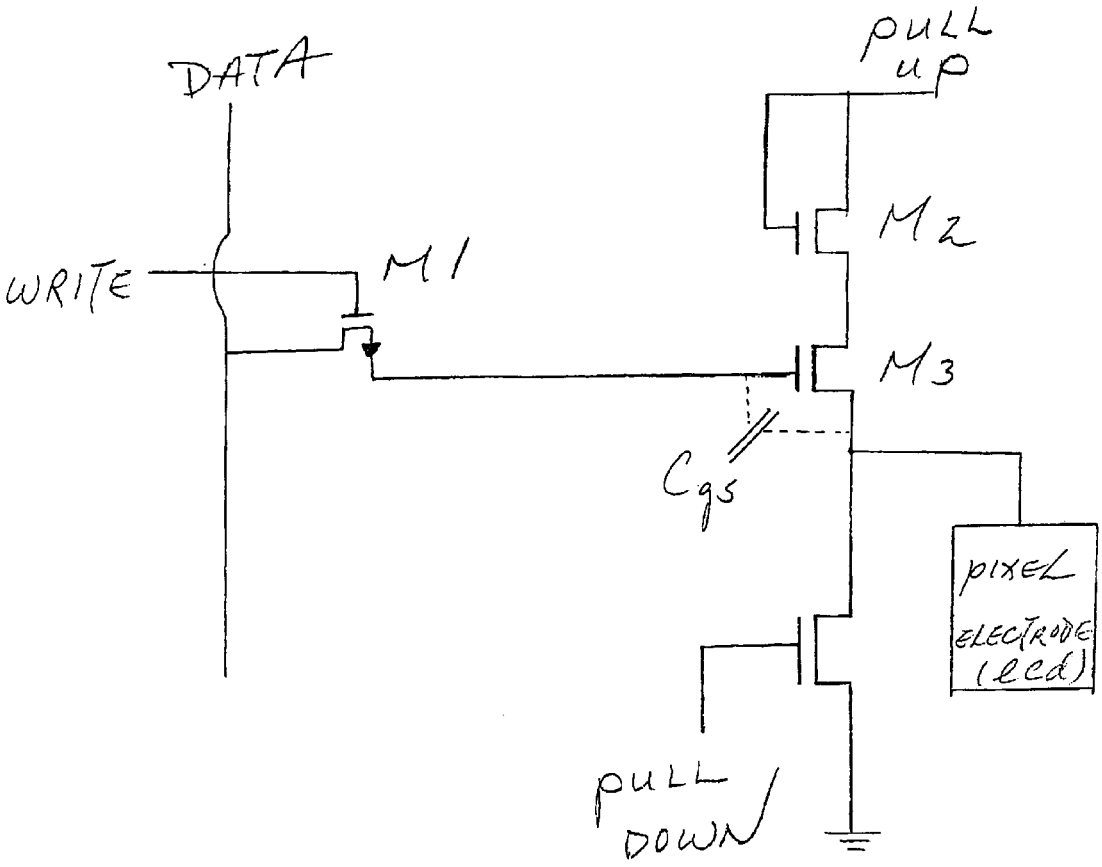
FIG. 4 is a diagram illustrating a second related art frame buffer pixel circuit.
Figure 5:
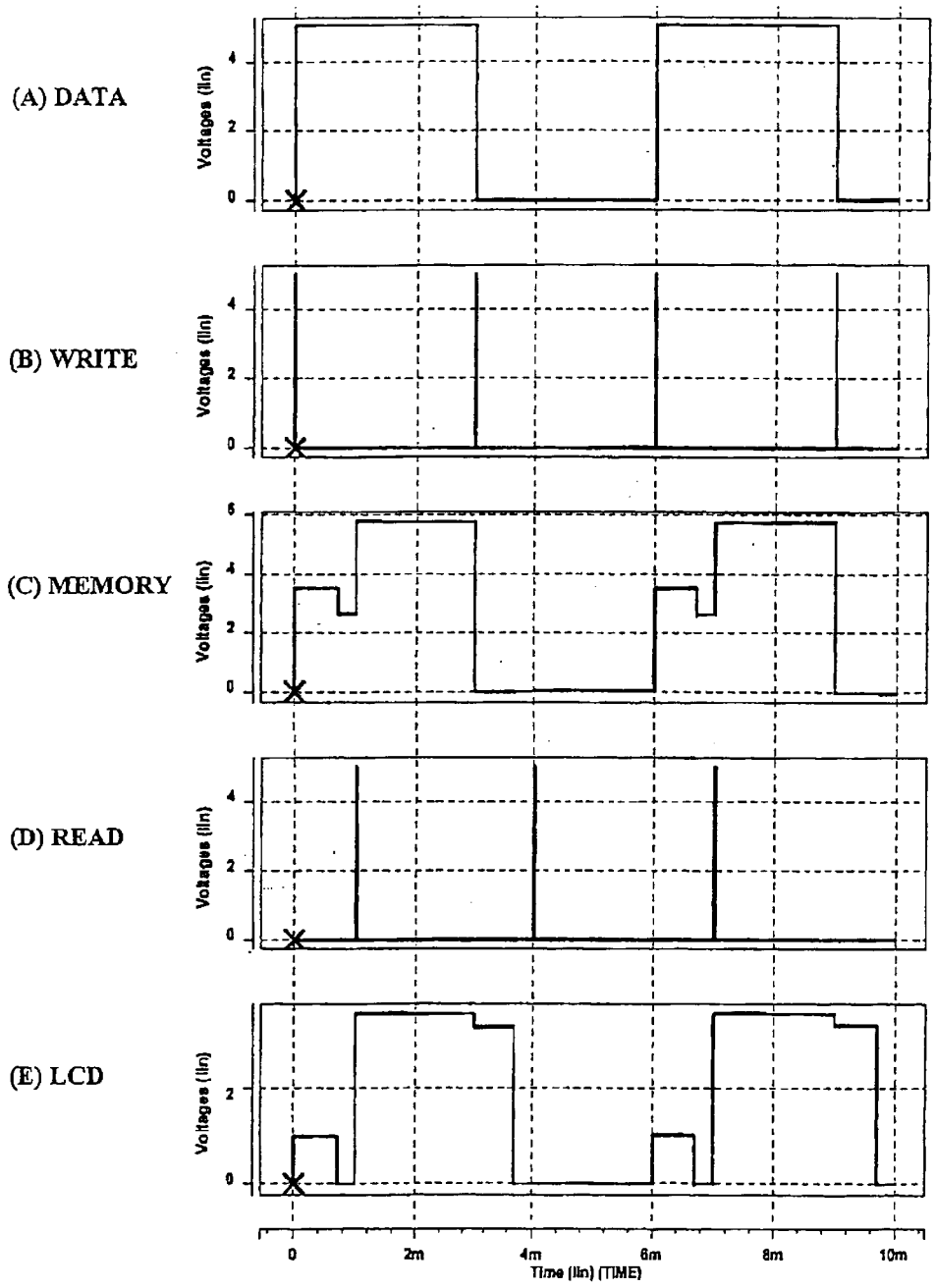
FIG. 5 shows simulation results for the frame buffer pixel circuit of FIG. 4.
Figure 6:
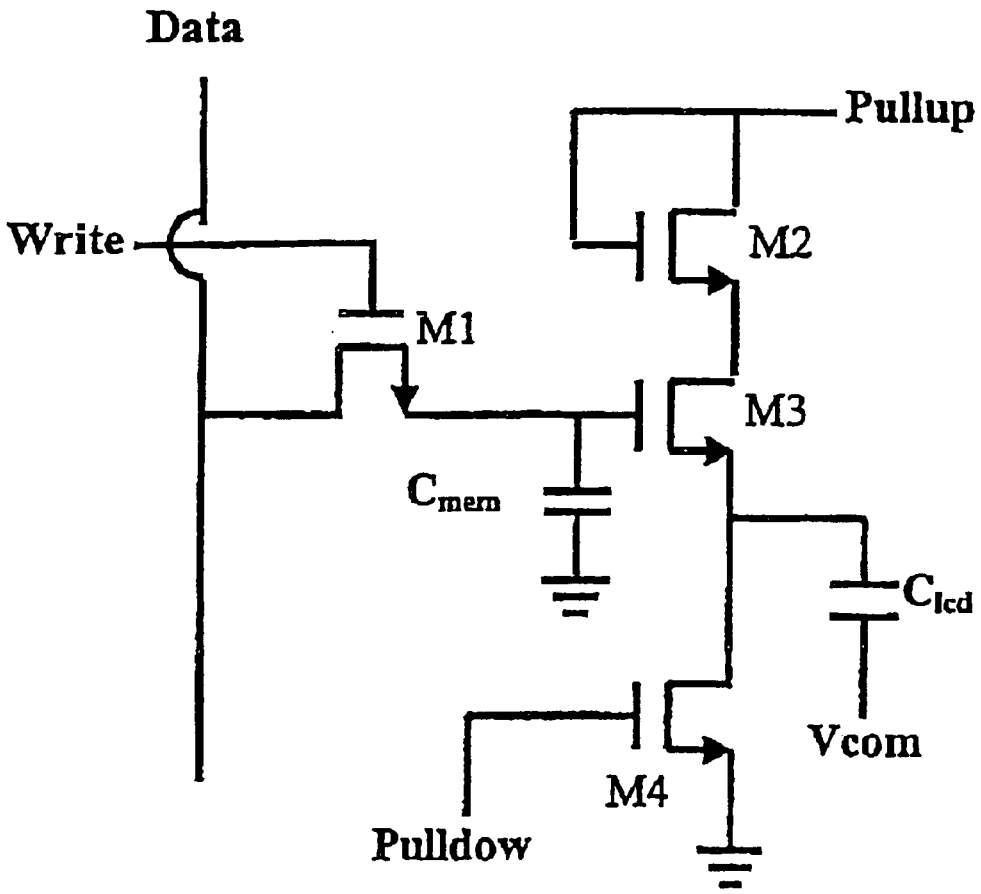
FIG. 6 shows a refined frame buffer pixel circuit.

FIG. 6 shows a first refined frame buffer pixel circuit. In this refined frame buffer pixel circuit, a memory capacitor $C_{mem}$ is put in the related art frame buffer pixel circuit of FIG. 4, eliminating the charge induction problem caused by the gate capacitance of transistor M3 with the $C_{lcd}$ capacitor, which forms an additional path to the ground. The image quality is greatly improved after the capacitor $C_{mem}$ put in the related art frame buffet circuit and transistor M3 is preferably made from a minimum-sized transistor. Furthermore, as described below, the values of capacitors $C_{gs}$ and $C_{lcd}$ can be optimized to achieve best image quality.

FIG. 7 shows a second refined frame buffer pixel circuit. In this second refined frame buffer pixel circuit, two field effect transistors (FETs), M1 and M2, are used as control or pass transistors. A pullup transistor M4 with an input signal corresponding to the Read signal is coupled between in after the memory transistor M3 and the LCD capacitor $C_{lcd}$ and a Pulldown transistor M5. In this circuit, when the Write signal is ON, the pass transistors, M1 and M2, pass the pixel data value through to the gate of the M3 transistor. At this time, the M3 transistor is not in a conducting state since the Pullup signal is kept low so that no current is flowing through the source and drain electrodes of either M4 or M5 transistors.

After loading the data value, the M1 and M2 transistors are preferably turned off. This will keep the new pixel data value stored on the gate of M3. Subsequently, at the end of the display of previous data value, the Pulldown signal is switched to high and turns on the M5 transistor, which then discharges any charge on the pixel electrode, $C_{lcd}$. Afterwards, the Pulldown signal is turned low and turns off the M5 transistor. Then, the Pullup signal is switched to high and turns on the M4 transistor, which causes current to flow through the M3 transistor. The data value stored on the gate of the M3 transistor controls the amount of current, which determines the voltage charged at the pixel electrode, $C_{lcd}$ proportionally to the voltage level when the Read signal is applied. The two pass transistor arrangement of this embodiment is advantageous in a number of respects. First, the use of two pass transistors guarantees that all voltage in one node is transferred to the other node. In contrast, if only one transistor is used, there is voltage drop at a lower or upper range of the applied voltage. For example, if NMOS is used, when upper rail voltage VDD is applied, VDD−Vth is transferred to the other node. Vth=threshold voltage of the NMOS. For PMOS, VSS+Vth is transferred to the other node as with lower rail voltage input.

Second, the charge-sharing and charge-inducing problems are eliminated because transistor M4 disconnects the gate capacitor M3 and the pixel capacitor $C_{lcd}$. Voltage according to the Data level is first stored in the memory capacitor, the gate capacitor of transistor M3, during data writing time. Since the two capacitors are isolated due to M4 transistor, there is no charge induced during data writing time, which is clearly shown in FIG. 8(C) and (D).

FIG. 8 shows simulation results performed for the refined frame buffer pixel FIG. 7. In FIG. 8(E), the voltage at the $C_{lcd}$ capacitor remains stable over an entire frame time for each Data level, and there is no induced charge at the LCD when Write signal is on. Especially, the value of $C_{gs}$ of the M3 transistor and $C_{lcd}$ can be optimized independently to hold the charge stored in each capacitor for one frame time since there is no parasitic path connecting the two capacitors. The darkest level remains at its lowest brightness level with no change for the entire frame time, and the contrast ratio increases with no brightness change. Particularly, the contrast ratio does not depend on whether a separate capacitor is used or a gate capacitor is used. A previously stored image can therefore be displayed with no significant deterioration. Regarding optimization, it is noted that the $C_{gs}$ to the M3 and $C_{lcd}$ can be optimized independently since the M4 transistor between the two disconnects any possible parasitic electrical path. However there is an additional electrical path with the $C_{gs}$ of M4 and $C_{lcd}$ and charge is induced at the $C_{lcd}$ when Read signal is turned on. The charge induced at the $C_{lcd}$ during data read time is same no matter what voltage is stored at the $C_{gs}$ of M3. It is not critical to optimize the $C_{gs}$ of M4 and the $C_{lcd}$. Using minimum sized transistor for M4 is therefore desirable.

Furthermore, the gate capacitance used in this pixel circuit depends on the voltage applied to the gate, as shown in FIG. 9. In FIG. 9, the values of gate capacitor are acquired from the particular simulation shown in FIG. 8 with NMOS and PMOS having widths of 7.5 $\mu$m and 7.3 $\mu$m respectively, and lengths of 9.2 $\mu$m and 9.5 $\mu$m respectively. The threshold voltage of the PMOS and NMOS are 0.94 V and 0.77 V respectively. If the voltage applied to the gate of a device becomes close to the threshold voltage of the device, the gate capacitance starts to decrease. Therefore, a pixel with a gate capacitor as a storage capacitor has the disadvantage of inconsistent capacitance, requiring that the stored voltage at M3 be larger than the threshold voltage of M3.

Also, it is noted that there could be a charge induced at the $C_{led}$ capacitor when the Read signal is on, if the ratio of the $V_{gs}$ of M4 to the $C_{lcd}$ capacitance is comparable, even though there is no induced charge at the $C_{lcd}$ capacitor due to the voltage applied at the memory capacitor. The induced charge is same regardless of the voltage stored at the memory thus causing no decrease of contrast ratio.

FIG. 8(E) shows the charge induced at the $C_{lcd}$ capacitor during data reading time when the displaying Data level is zero. This results from the parasite capacitance of M4, which makes an electrical path to the ground with the $C_{lcd}$ capacitor. But this induced charge can be removed easily by minimizing the gate capacitor of M4 and maximizing the $C_{lcd}$ capacitance. Still, the optimization of the $C_{lcd}$ capacitor and $C_{gs}$ of M3 can still be done independently.

FIG. 10 shows a first preferred embodiment of a frame buffer pixel circuit of the present invention. In this preferred embodiment, the pixel circuit includes a separate capacitor, $C_{mem}$, which is put in before the transistor M3. The $C_{mem}$ is a memory capacitor, and is used to replace the parasitic gate capacitor of the CMOS transistors. This pixel circuit with a separate capacitor $C_{mem}$ yields higher contrast ratio by removing the induced charge at $C_{led}$ during data writing and reading time, keeping the dark level at its lowest brightness. Thus, the design of a frame buffer pixel becomes easier because of the added separate capacitor. The optimization of the two capacitors, $C_{mem}$ and $C_{lcd}$, can be done independently. Further, the capacitance of $C_{mem}$ does not depend on the stored voltage while the gate capacitance changes its value according to the stored voltage. The stored voltage can be kept for the same duration regardless of the voltage level. Any suitable capacitor can be used to form $C_{mem}$. It is preferable, however, that $C_{mem}$ be made by using typical CMOS processes that have double POLY layers, such as the AMI 0.5 um double-poly triple-metal CMOS process. For this circuit, the sub-frame frequency and the pixel size are correlated. For a field sequential color display with frame frequency of 60 Hz, the total sub-frame frequency will be 180 Hz and the sub-frame time is about 5.5 msec. With higher sub-frame frequency the voltage holding time, RC time is reduced. Thus, the pixel is also decreased since the RC time which is proportional to the capacitor size is decreased. The size of capacitor take major area in a pixel. Also, in this circuit the capacitors may be optimized. Determining the size of capacitor to hold the stored voltage for a certain period of time will achieve this optimization. Since $C_{mem}$ and $C_{lcd}$ can be independently determined to hold the stored voltages for the same sub-frame time the capacitor can be same. For a TFT display which requires the frame frequency of 60 Hz, about 100 ff capacitance may be used to hold 95% of the stored voltage for 16.7 msec. A field sequential color display which has three times larger sub-frame frequency requires about 30 ff capacitance, which is one-third of the capacitance for the TFT display.

According to this embodiment, there is no charge sharing between the storage capacitor, $C_{mem}$, and the LCD capacitor, $C_{lcd}$, as shown in FIG. 11(A)–(E). A charge induced at the LCD electrode can be minimized by using minimum-sized transistor. The LCD electrode is directly driven by the power source and the charged voltage is controlled by the voltage level stored at the memory capacitor, $C_{mem}$. In this pixel circuit, each capacitor can be designed independently such that the time constant is long enough to hold the stored charge for one frame time. Particularly, the capacitance of the separate capacitor is not dependent on the stored voltage level. Additionally, there is no trade off between brightness and contrast ratio. The brightness and contrast ratio can thus be improved at the same time. Data writing time is also limited only by the entire frame time since the data writing and displaying previous image is per formed simultaneously. This data writing time limitation releases the burden of data processing time, especially the operation speed of shift registers while non-frame buffer pixel requires as fast data write time as possible to get more viewing time. The frame buffer pixel circuit thus provides high quality image by saving data writing time.

Further, this embodiment of the frame buffer pixel circuit complements the low brightness of displays, especially the Field Sequential Color displays. The frame buffer pixel technology can also be used with any form of analog liquid crystal (LC) modes, such as HAN (hybrid aligned nematic), OCB (optically compensated birefringence), ECB (electrically controlled birefringence), FLC (ferro-electric liquid crystal). Most of all, there is tremendous flexibility in designing the frame buffer pixel circuit, almost any type of capacitor can be used for the memory capacitor and the liquid crystal capacitor.

Figure 12:
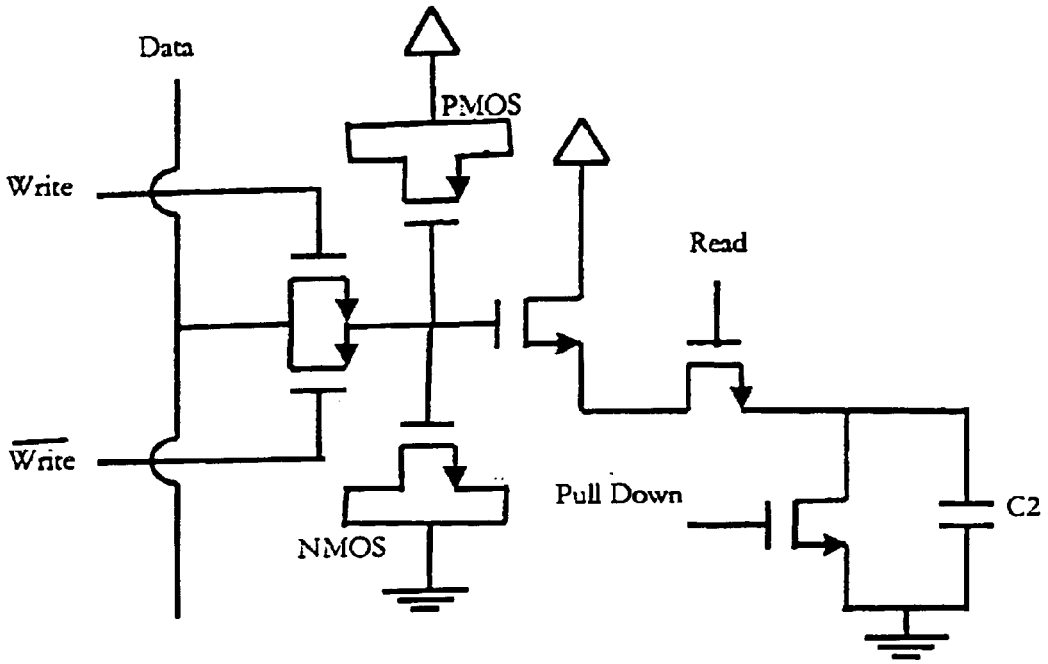
FIG. 12 is a diagram of an embodiment of the present invention implemented using NMOS and PMOS transistors.

For example, a combination of NMOS and PMOS transistors can be used as a capacitor that compensates the voltage dependent characteristic of the NMOS and PMOS transistors. If the gate capacitors of PMOS and NMOS are used in parallel for the memory, the total capacitance is the sum of the two capacitor and the combined capacitor will not experience abrupt decrease near threshold voltage. For example an NMOS capacitor will only experience capacitance drop near a threshold voltage of NMOS, about 0.7 V, but the combined is tolerant over the decrease of NMOS gate capacitor at the threshold of NMOS, thanks to that of PMOS since the gate capacitance is not affected. FIG. 12 shows a circuit constructed in this manner.

Figure 13:
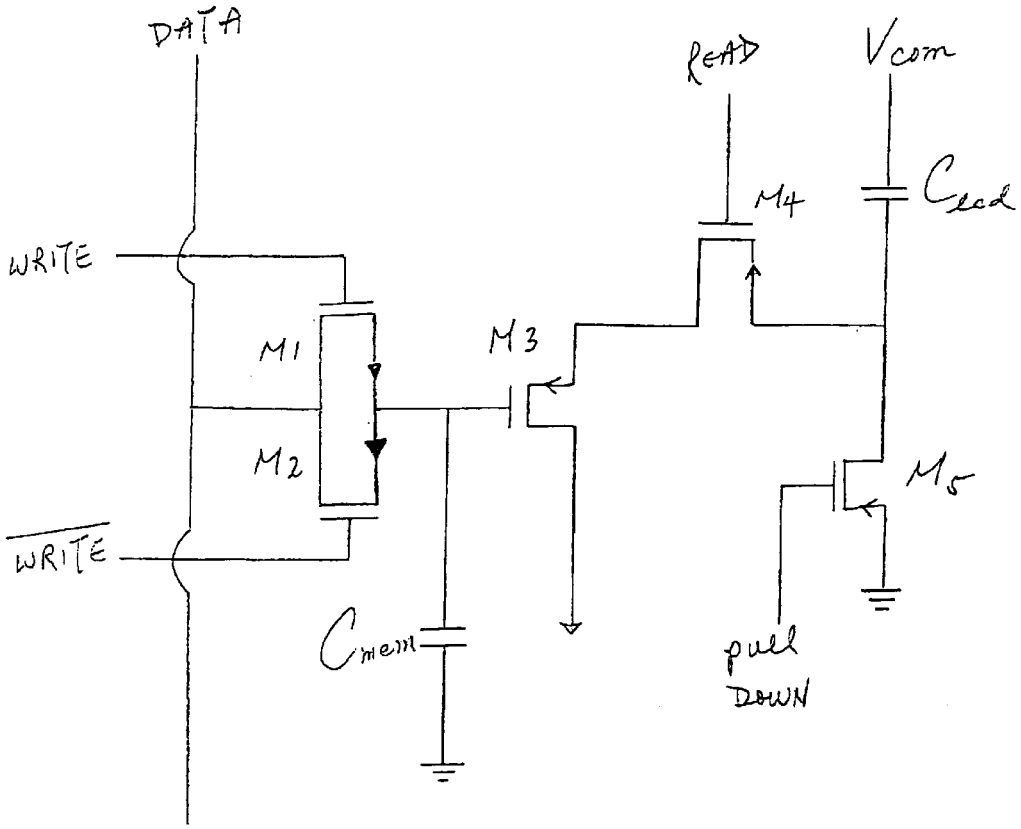
FIG. 13 shows a frame buffer pixel circuit with PMOS in accordance with a preferred embodiment of the present invention.

FIG. 13 illustrates a frame buffer pixel circuit according to another preferred embodiment of the present invention. Referring to FIG. 13, the M3 transistor is preferably a PMOS. The PMOS is connected to the opposite signal of Pullup and Read respectively because these transistors work as a gate transistor supplying the current source in the circuit. In this embodiment, transistors M3, M4, and M5 may be PMOS transistors. In this case, the pixel voltage will vary from VSS to GND, where V22<0. And, the polarity of the pulses for M3, M4, and M5 need to be reversed for appropriate operation. Further, the data will also be negative too. In addition, both the first embodiment and the second embodiment, the M2 transistor can be omitted without loss of any general functions or performance of the frame buffer circuit and any of the advantages over the conventional frame buffer circuit.

Figure 14:
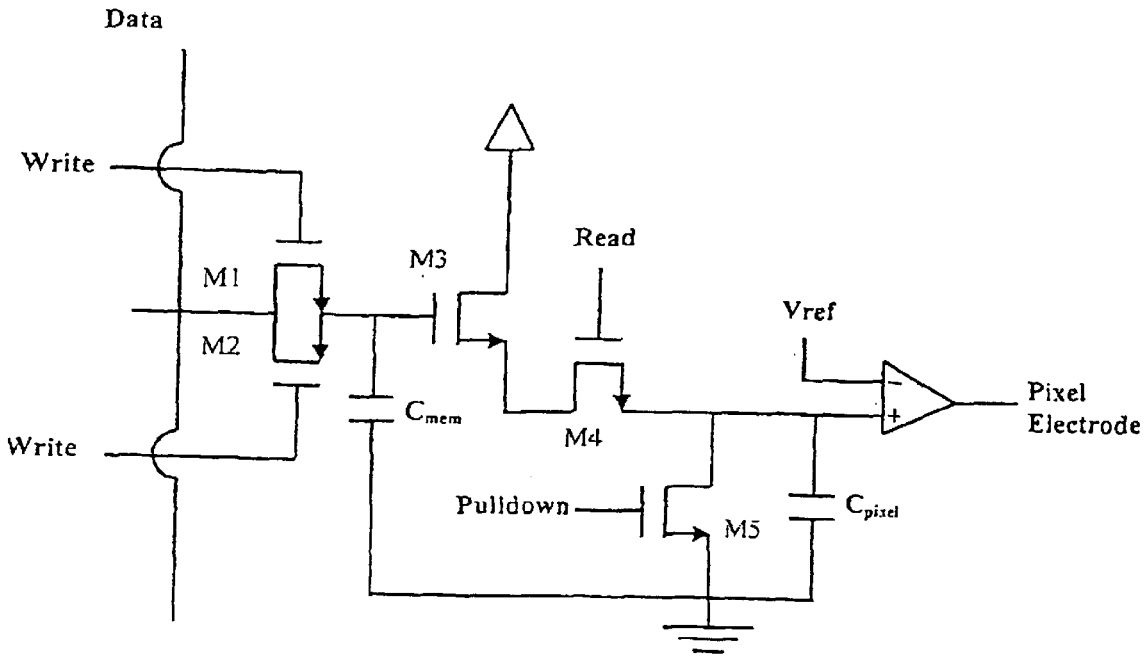
FIG. 14 is a circuit diagram illustrating a frame buffer pixel circuit with a comparator in accordance with a preferred embodiment of the present invention.
Figure 15:
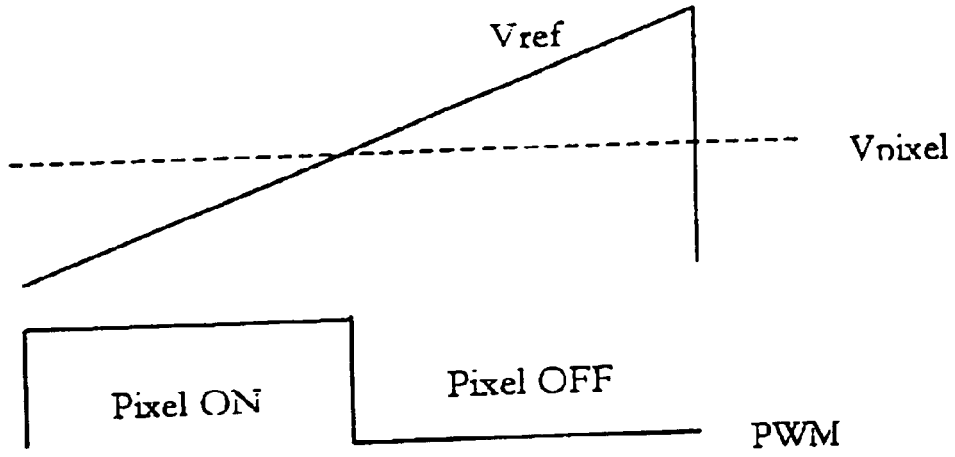
FIG. 15 is a diagram showing how PWM wafer may be generated in accordance with one embodiment of the present invention.

FIG. 14 shows the third preferred embodiment of the claimed invention. In this scheme, a frame buffer pixel circuit with an analog to PWM (pulse width modulation) converter is illustrated. A comparator is put in before the pixel electrode. The comparator compares the voltage stored at pixel capacitor $C_{pixel}$ and a voltage, $V_{ref}$ supplied globally at the same time when the pixel electrode is charged. If $V_{pixel}>V_{ref}$ the voltage at the pixel electrode is 5 volt or the driving voltage (VDD) and if $V_{pixel}<V_{ref}$, the voltage at the pixel electrode is 0 volt or ground (GND). The PWM pulses generated from the comparator is used to drive binary displays such as ferroelctric liquid crystal display(FLCD) and digital mirror display(DMD) in a reduced sub-frame frequency. In this embodiment, the addition of the comparator is designed to drive an analog displays. The shape of Vref, as shown in FIG. 15, determines how long 5 volt level and 0 volt level are maintained respectively.

FIG. 16 shows the PWM waveforms generated by the global reference voltage $V_{ref}$ and the stored pixel voltage $V_{pixel}$. The PWM waveform at the pixel electrode with a common electrode held at either VDD or GND switches a binary device either ON or OFF. Depending on the pixel voltage the ON time and OFF time are determined, enabling gray level representation in binary with reduced sub-frame frequency. The typical binary devices are devices like deformable micro mirror device (DMD) and ferro-electric liquid crystal display (FLCD) which use Field Sequential Color method to implement full color images. The PWM waveform significantly reduces the number of switching, as a result, the reduced number of switching increases the life time of the DMD and lessen the burden of switching time for the FLCD, allowing more gray scale levels. In other word, a higher quality of image display is achieved due to the reduced switching time. Further, the waveform of the $V_{ref}$ can be varied by applying gamma correction, as shown in FIG. 17. Since light intensity is not typically linearly proportional to the analog voltage, gamma compensation is preferable for generating better image.

The frame buffer pixel circuit of the claimed invention can be applied to the Field Sequential Color display which has lower brightness than 3-panel display but whose optical structure is very compact. The circuit can also be applied to the reflective and transmission display. It will be more effective in the reflective display that usually adopts silicon substrate backplanes, such as liquid crystal on silicon (LCOS). Further, the circuit can be applied to the direct view display and projection display, such as a phosphate buffered saline (PBS) display system. Direct view display includes head mount display (HMD), displays for monitor, personal digital assistant (PDA), view finder, and etc. Examples of projection display with field sequential color are shown in FIGS. 18 and 19. In FIG. 18, a 1-panel projection display with field sequential color is illustrated. In FIG. 19, a 2-panel projection display with partial field sequential color is illustrated. The main purpose of the frame buffer pixel circuit is to increase the brightness of the display with no loss of contrast ratio. This invention will be effective in these applications yet it can be applied to 3-panel projection display to increase the brightness of the system more.

The present invention has been described relative to a preferred embodiment. Improvements or modifications that become apparent to persons of ordinary skill in the art only after reading this disclosure are deemed within the spirit and scope of the application.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures.

What is claimed is:

1. An analog frame buffer pixel system, comprising:

a first storage unit for storing first analog data;

a first controller for enabling storage of the first analog data in the first storage unit;

a second storage unit for storing a second analog data proportional to the first analog data and corresponding to a grayscale pixel value to be displayed;

a display for displaying the pixel value corresponding to the second analog data stored in the second storage unit;

a second controller to enable storage of the second analog data into the second storage unit;

a drain unit for draining voltage from the second storage unit after the pixel value is displayed, wherein the first storage unit includes a transistor having a first terminal for storing the first analog data, a second terminal coupled to a supply potential, and a third terminal coupled to the second storage unit, said first terminal coupled to the first controller and corresponding to a gate of the transistor; and a capacitor coupled between the fist terminal of the transistor and a reference potential.

2. The system according to claim 1, wherein the first controller includes a pass gate which, when turned off, causes the first analog data to be stored at the gate of the transistor.

3. The system according to claim 2, wherein the pass gate includes at least one of an NMOS transistor and a PMOS transistor.

4. The system according to claim 2, wherein the the pass gate includes NMOS transistor and PMOS transistor which are controlled by Write and Inverted Write signals respectively.

5. The system according to claim 1, wherein the second controller comprises a transistor having a gate coupled to a Read signal.

6. The system according to claim 1, wherein the display comprises a pixel electrode and a capacitor, the capacitor being independently optimized to hold a charge corresponding to the pixel value for one frame time.

7. The system according to claim 1, wherein the drain unit comprises a transistor having a gate connected to a Pulldown signal.

8. The system according to claim 1, wherein the display is a liquid crystal display.

9. The system according to claim 1, further comprising:

a power source coupled to the second storage unit which includes a capacitor, wherein the second controller allows the power source to charge the capacitor of the second storage unit to a value which corresponds to the second analog data, the second controller allowing the power source to charge the capacitor of the second storage unit through the first storage unit based on the first analog value.

10. An analog frame buffer pixel system, comprising:

a first storage unit for storing first analog data;

a first controller for enabling storage of the first analog data;

a second storage unit for storing a second analog data proportional to the first analog data;

a display for displaying a pixel value based on the second analog data stored in the second storage unit;

a second controller to enable storage of the second analog data into the second storage unit to the display;

a drain unit for draining voltage from the second storage unit after the pixel value is displayed; and an analog to pulse width modulation (PWM) converter coupled between an output of the second storage unit and an input of a pixel electrode, wherein the first storage unit includes:

a transistor having a first terminal coupled to the first controller, a second terminal coupled to a supply potential, and a third terminal coupled to the second storage unit, said first terminal corresponding to a gate of the transistor, and a capacitor coupled to a node disposed between the gate of the transistor and the first controller.

11. The system according to claim 10, wherein the capacitor has a capacitance independent from the first data stored in the capacitor, and wherein the first controller includes a pass gate.

12. The system according to claim 11, wherein the capacitor comprises a complementary metal oxide semiconductor (CMOS) having double POLY layers.

13. The system according to claim 11, wherein the pass gate includes at least one of an NMOS transistor and a PMOS transistor.

14. The system according to claim 11, wherein the pass gate includes an NMOS transistor and a PMOS transistor controlled by Write and Inverted Write signals respectively.

15. The system according to claim 10, wherein the second controller comprises a transistor having a gate coupled to a Read signal.

16. The system according to claim 10, wherein the display comprises a pixel electrode and a capacitor, the capacitor being independently optimized to hold a charge corresponding to the pixel value for one frame time.

17. The system according to claim 10, wherein the drain unit comprises a transistor having a gate connected to a Pulldown signal.

18. The system according to claim 10, wherein the converter comprises a comparator which compares the second analog data to a reference value and outputs a binary value corresponding to said pixel value.

19. The system according to claim 18, wherein the reference voltage swings within a voltage range generated from the frame buffer pixel.

20. The system according to claim 10, further comprising:

a power source coupled to the second storage unit which includes a capacitor, wherein the second controller allows the power source to charge the capacitor of the second storage unit to a value which corresponds to the second analog data, the second controller allowing the power source to charge the capacitor of the second storage unit through the first storage unit based on the first analog value.

21. A frame buffer pixel circuit for a display system, comprising:

a first storage unit which stores first analog data;

a second storage unit which stores second analog data proportional to the first analog data in the first storage unit;

a controller which couples the first storage unit to the second storage unit to enable storage of the second analog data in the second storage unit; and a pixel electrode for displaying a pixel value corresponding to the second analog data stored in the second storage unit, wherein the first storage unit includes a transistor having a first terminal for storing the first analog data, a second terminal coupled to a supply potential, and a third terminal coupled to the second storage unit, said first terminal corresponding to a gate of the transistor; and a capacitor coupled between the fist terminal of the transistor and a reference potential.

22. The circuit according to claim 21, further comprising:

a power source coupled to the second storage unit which includes a capacitor, wherein the controller allows the power source to charge the capacitor of the second storage unit to a value which corresponds to the second analog data based on the first analog value.

* * * * *